US006360161B1

(12) United States Patent
Francis et al.

(10) Patent No.: US 6,360,161 B1
(45) Date of Patent: Mar. 19, 2002

(54) METHOD AND SYSTEM FOR FUEL INJECTOR COEFFICIENT INSTALLATION

(75) Inventors: Dell C. Francis, Bristol; Scott A. Koerner, Kenosha; Patrick R. Taylor, Elkhorn; Patrick C. Tetzlaff, Franklin, all of WI (US)

(73) Assignee: Bombardier Motor Corporation of America, Grant, FL (US)

( * ) Notice: Subject to any disclaimer, the term of this patent is extended or adjusted under 35 U.S.C. 154(b) by 0 days.

(21) Appl. No.: 09/566,000

(22) Filed: May 4, 2000

(51) Int. Cl.[7] ..... F02M 51/00; G06G 19/00

(52) U.S. Cl. ..... 701/115; 73/119 A; 123/486

(58) Field of Search ..... 123/478, 480, 123/486, 491; 73/119 A; 701/103, 104, 105, 115

(56) References Cited

U.S. PATENT DOCUMENTS 5,575,264 A * 11/1996 Barron ..... 123/486
5,611,314 A * 3/1997 Fuwa et al. ..... 123/491
5,634,448 A 6/1997 Shinogle et al. ..... 123/480
5,687,050 A 11/1997 Bartsch ..... 361/154
6,021,754 A * 2/2000 Kendrick ..... 123/478

* cited by examiner

*Primary Examiner*—Willis R. Wolfe
(74) *Attorney, Agent, or Firm*—Timothy J. Ziolkowski; Cook & Franke SC

(57) ABSTRACT

State-of-the-art fuel injectors can be defined by a third-order polynomial to define their performance curve and to optimize performance of the fuel injected engine. Such systems are preprogrammed to use a set of fixed coefficients when replacing fuel injectors. Therefore, these replacement fuel injectors must be manufactured with very precise tolerances so as to operate efficiently with these fixed coefficients. The present invention includes a method and apparatus that allows the use of production fuel injectors that are more economical since they can be manufactured with wider tolerances. The production fuel injectors are supplied with a computer program and a data file having a set of replacement coefficients that are determined especially for that particular fuel injector. The approach allows the restoration of the existing coefficients if the replacement fuel injector does not solve the service problem experienced by the user of the fuel injected engine. The new, replacement fuel injector, together with its specific coefficients, can then be used in another application.

32 Claims, 4 Drawing Sheets

FIG. 1A
(PRIOR ART)
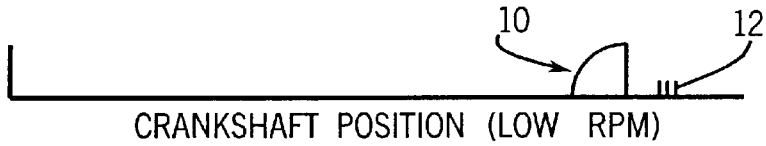
FIG. 1B
(PRIOR ART)
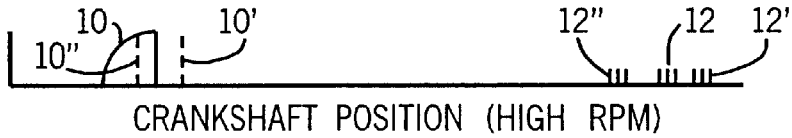
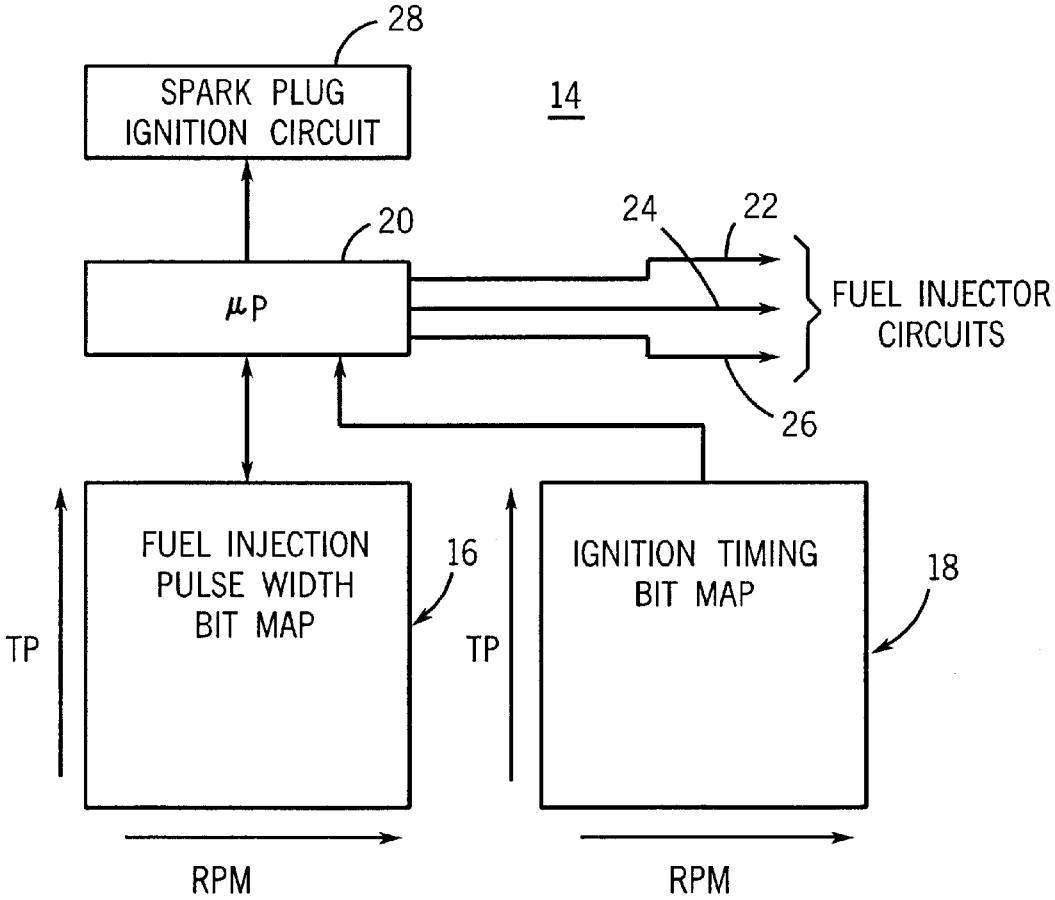
FIG. 2
(PRIOR ART)

FIRING SIGNAL TO CYLINDERS
48
46
44
42
40
36
IGNITION CIRCUIT
38
62
FUEL INJ.
60
FUEL INJ.
58
FUEL INJ.
56
FUEL INJ.
54
FUEL INJ.
52
FUEL INJ.
50
34
THROTTLE POSITION SENSOR
30
ELECTRONIC CONTROL UNIT ECU
32
RPM SENSOR
READ ONLY MEMORY
64
READ AND WRITE MEMORY
66
CALCULATOR
68

76
74
72
70
FUEL FLOW
PULSE WIDTH OF CONTROL SIGNAL 84
82
80
78
FUEL FLOW
PULSE WIDTH OF CONTROL SIGNAL

METHOD AND SYSTEM FOR FUEL INJECTOR COEFFICIENT INSTALLATION

BACKGROUND OF THE INVENTION

The present invention relates generally to fuel injection systems for internal combustion engines, and more particularly to, a method and apparatus for installing fuel injector coefficient data, that is specific to a particular fuel injector, in an engine controller when replacing a fuel injector.

In typical prior art fuel injected engines, it is generally considered desirable that each injector deliver approximately the same quantity of fuel in approximately the same timed relationship to the engine for proper operation. It is well known that problems arise when the performance, or more particularly the timing, and the quantity of fuel delivered by the injectors diverge beyond acceptable limits. For example, injector performance deviation or variability will cause different torques to be generated between cylinders due to unequal fuel amounts being injected, or from the relative timing of such fuel injection. Further, knowledge that such variations occur, requires engine system designers to account for this variability by designing an engine system to provide an output equal to the maximum theoretical output less an amount due to the worse case fuel injector variability rather than design a system for peak or maximum cylinder pressures or output.

Various attempts have been made for solving these problems associated with fuel injectors. One straight forward approach is to simply adhere to rigid manufacturing and test procedures to assure each injector meets a rigid desired design specification. Unfortunately, the increased manufacturing and assembly costs and the low yield of acceptable units makes this approach undesirable.

Sophisticated electronic equipment and control have made it possible to better control the problem of timing and delivery variations of similar fuel injectors. One such control involves compensating for individual injector variations and includes an electronic control module having a memory for storing compensation signals for each injector. The compensation signals used are derived from observed performance parameter values taken at a number of operating conditions and further include a plurality of sensors for detecting at least one and preferably a number of operating parameters. One or more operating parameter signals are then generated which are then provided to the memory. The electronic control module adjusts the base fuel delivery signal for each injector as a function of the compensation data signal for that injector. Unfortunately, some of the more complex and advanced fuel injectors now being manufactured do not follow readily predictable fuel-flow characteristics with increased pulse-width inputs, as was the case with earlier style injectors. Consequently, unless individual compensation signals are determined for an extremely large number of operating points resulting from different pulse widths, such systems would not operate satisfactorily with those advanced fuel injectors. Also, the amount of memory to store a sufficiently large number of compensation signals covering the full range of fuel injector operation would be excessively large, and the cost involved in the necessary testing to determine such a large number of compensation signals would be unacceptable.

The advanced fuel injector are very complicated and difficult to manufacture and therefore it is very difficult to have consistent operating characteristics between injectors even though they are intended to be substantially identical. Further, although varying pulse width of a control signal is used to vary the amount of fuel an injector provides to a cylinder (hereinafter referred to as fuel flow or flow rate), a performance curve of these complicated fuel injectors (fuel flow vs. pulse width) cannot be accurately defined by a second-order polynomial as can some older types of fuel injectors. Instead, the advanced fuel injectors must be defined by a third-order polynomial. Consequently, determining the pulse width for a desired RPM by extrapolating between sample data points does not provide satisfactory performance. By calculating the pulse width for each fuel injector individually for each desired RPM setting, substantially increased effectiveness of these advanced complicated fuel injectors can be achieved.

To determine the proper pulse width for a desired RPM for each fuel injector used in the engine, the coefficients for a third-order polynomial, which most closely define a performance curve of each fuel injector, are stored in a read/write memory associated with a specific cylinder in the engine. In addition, the basic form of a third-order polynomial is also stored and available for use by a microprocessor in the ECU (electronic control unit). The microprocessor retrieves the coefficients for each fuel injector and then uses the coefficients for the specific fuel injector to solve the basic third-order polynomial to determine the appropriate pulse width for a given throttle position or desired RPM thereby causing the correct amount of fuel to be injected into the cylinder to achieve the desired RPM.

Before the coefficients of a third-order polynomial representing the performance curve of a specific fuel injector can be stored in the read/write memory so as to be retrievable by the engine ECU, they must be determined. It is also important that a failed fuel injector can be replaced by a new injector which will also operate effectively with any cylinder.

Accordingly, each fuel injector is tested on a test flow bench by applying a signal pulse having a selected minimum width and then measuring the fuel flow rate. The pulse width is then increased a known amount and the resulting fuel flow rate again is measured. The process is repeated a number of times, such as 8 to 10 times, to obtain a series of data points which relate pulse width to a fuel flow rate.

These data points are then used to determine a third-order polynomial such as $ax^3+bx^2+cx+d=0$, which can also be used to define a performance curve representative of the fuel flow output of the fuel injector for any pulse width. The pulse width can then be correlated to the desired RPM. The degree of fit ($R^2$) of said data points to the performance curve defined by the third-order polynomial is also determined within selected limits such that those fuel injectors which fall outside of the selected degree of fit are discarded. The coefficients of at least a portion of those fuel injectors which fall within the selected degree of fit are used to determine a nominal performance curve. Selected upper and lower limits are then set with respect to the nominal curve at each of the pulse-width values used to test the multiplicity of fuel injectors and then the fuel injectors are compared with the nominal curve to determine if the performance curve of each individual fuel injector stays within or exceeds the upper and lower limits of the nominal curve. Those that stay within the upper and lower limits are then used for assembly and replacement parts.

It will be appreciated by those skilled in the art that the third-order polynomial coefficients for each curve representing a fuel injector may be determined by various techniques including manual calculations. A regressive analyzer can also be particularly useful. Such a regressive analyzer can provide the degree of fit according to a least squares method wherein $R^2=1$ is considered a perfect fit. A degree of fit for $R^2>0.998$ has been found to provide a suitable threshold for attaining or discarding fuel injectors as discussed above.

When an engine is initially manufactured, the coefficient data can be determined empirically by any such method. Coefficient data for each of the particular fuel injectors to be installed in the engine is written into read/write memory for use by the ECU microprocessor. To subsequently replace a failed fuel injector, it is then necessary to replace the third-order polynomial coefficient data to the read/write memory over the coefficient data of the failed fuel injector, so that during future operations of the engine, the new coefficient data will be available for use by the ECU microprocessor. To simplify this service process, the prior art preprograms a set of service injector coefficient data in the ECU memory and manufactures all service injectors under stringent tolerance requirements so as to function with the known service coefficients. In this manner, whenever a fuel injector fails, one of the special service fuel injectors is installed, and the ECU is simply instructed to use the service coefficient data for that particular cylinder. While this approach results in satisfactory operating conditions, it is relatively costly. That is, to manufacture each service injector with such stringent tolerances so that the flow rate satisfies a desired performance curve dictated by the fixed service injector coefficient data, results in a relatively expensive replacement fuel injector.

It would therefore be desirable to use an off-the-shelf, production fuel injector with wider tolerances so that custom coefficient data for that particular injector can be written to the memory location for the targeted cylinder, and use of the coefficient data can be restricted to give a relative level of confidence against misuse.

SUMMARY OF THE INVENTION

The present invention relates to a method and system to replace fuel injector coefficient data in an ECU of a fuel injected engine to enable use of the more economical production fuel injectors that overcomes the aforementioned problems.

The present invention provides a way to readily replace the aforementioned advanced fuel injectors in an engine, using a standard production fuel injector, that maintains effective and efficient fuel injector operation. The present invention includes storing coefficient data that is specific to a particular fuel injector, and providing that coefficient data, together with the associated fuel injector, to a customer for replacement in an engine. A computer program is also supplied to read out the existing coefficient data from the ECU before writing the replacement coefficient data so that restoration of the existing coefficient data, and the associated fuel injector, can be accomplished if the replacement fuel injector does not correct the service problem experienced. The system includes a log file to prevent misuse of the coefficient data by tracking how the program and data are used. That is, once the replacement coefficient data is used, the only way to reuse the data is if the original existing coefficient data is restored in the ECU from which it originated. If the data is restored, and it is assumed that the original fuel injector is reinstalled in the original cylinder from which it came, the program allows the reuse of the replacement coefficient data.

Therefore, in accordance with one aspect of the invention, a system to replace fuel injector data in an ECU when replacing a fuel injector in an engine is disclosed. The system includes a computer readable storage medium operable with a service computer connectable to transmit data to an ECU of a fuel injected engine. The computer readable storage medium has thereon replacement fuel injector coefficient data that corresponds precisely to the fuel injector to be installed in the engine. The computer readable storage medium also has a computer program which, when executed by the service computer, causes the service computer to write the replacement fuel injector coefficient data to the ECU for a specified replacement fuel injector.

In accordance with another aspect of the invention, a fuel injector service pack is disclosed that includes a single replacement fuel injector and a computer readable storage medium. The single replacement fuel injector of the service pack has a fuel flow characterized by a custom set of coefficients that are experimentally determined for that particular fuel injector. The computer readable storage medium has stored thereon a data file containing a serial number and the custom set of coefficients for that single replacement fuel injector. The storage medium also has a computer program that includes instructions which, when executed by the computer, causes the computer to allow identification of a cylinder in the fuel injected engine for which a fuel injector is to be replaced. The computer is also caused to read and store existing fuel injector coefficient data from an ECU of the fuel injected engine and write the custom set of coefficients from the data file to the ECU for use with the single replacement fuel injector.

The computer readable storage medium also includes a log file that is used by the computer program to track how the data file is used and ensure that the custom set of coefficients are not used with another fuel injector. That is, the computer program of the service pack causes the computer to allow restoration of the existing fuel injector coefficient data if the single replacement fuel injector did not solve a user problem and restricts use of the existing fuel injector coefficient data, and thus restricts use of the original fuel injector, to ensure that the original fuel injector is only used with its existing fuel injector coefficient data. The replacement fuel injector is then also only used with the replacement fuel injector coefficient data. The restoration process is allowed by writing a serial number of the single replacement fuel injector to the ECU when the custom set of coefficients are written to the ECU. The use of the data is restricted by reading and comparing each fuel injector serial number in the ECU with the serial number of the single replacement fuel injector as stored in the data file if the last use of the computer program was to replace data. If a match is present, the service pack software allows the existing fuel injector coefficient data to be written back into the ECU and directs that the original fuel injector be installed in the cylinder identified so that the ECU uses the existing fuel injector coefficient data with the original fuel injector.

In accordance with yet another aspect of the invention, a method of servicing an engine requiring fuel injector replacement includes identifying a fuel injector in need of replacement by cylinder number, establishing communication between a service computer and an ECU of the engine, and downloading ECU, engine, and fuel injector data from the ECU to the service computer. The method next includes writing replacement fuel injector coefficient data to the ECU for a replacement fuel injector for the specific cylinder identified. The method next includes installing the replacement fuel injector in that cylinder of the fuel injected engine.

In accordance with yet another aspect of the invention, a method is disclosed for providing replacement fuel injectors for a fuel injected engine that includes the steps of supplying a production fuel injector with relaxed tolerances as compared to a standard service fuel injector, and acquiring a set of coefficients that characterize a performance curve for that particular production fuel injector. The method of providing replacement fuel injectors also includes writing the set of coefficients to a transportable computer readable medium and providing a computer program on a transportable computer readable storage medium that, when executed, causes the computer to load the set of coefficients into an ECU of an engine in which the production fuel injector is to be installed.

Preferably, the method includes the additional steps of reading and storing existing fuel injector coefficient data from the ECU and allowing restoration of the existing fuel injector coefficient data while at the same time restricting use of the existing fuel injector coefficient data and the original fuel injector by writing a serial number of the replacement/production fuel injector to the ECU. Upon a request to restore data, the method includes reading data and comparing each fuel injector serial number in the ECU with the serial number of the replacement/production fuel injector. If a match is present, the method includes allowing the existing fuel injector coefficient data to be written back to the ECU, and then directing that the original fuel injector be installed in the cylinder identified.

The method and apparatus of the present invention allows for the use of a more economical production fuel injector when servicing an engine in the field. These production fuel injectors can be manufactured with relaxed tolerances since a specific set of coefficients are determined experimentally and supplied for each injector such that the coefficients of a third-order polynomial result in a desired performance curve of fuel flow versus pulse width, as previously described.

Various other features, objects and advantages of the present invention will be made apparent from the following detailed description and the drawings.

BRIEF DESCRIPTION OF THE DRAWINGS

The drawings illustrate the best mode presently contemplated for carrying out the invention.

In the drawings:

FIGS. 1(*a*) and (*b*) are graphs illustrating how the position of the fuel injection pulse and the pulse width as well as the ignition timing may be varied with respect to crankshaft position.

FIG. 2 is a block diagram of a prior art system for optimizing operational characteristics of an engine by adjusting the fuel injection pulse width to all cylinders for a given throttle position.

DETAILED DESCRIPTION OF THE PREFERRED EMBODIMENT

Figure 6:
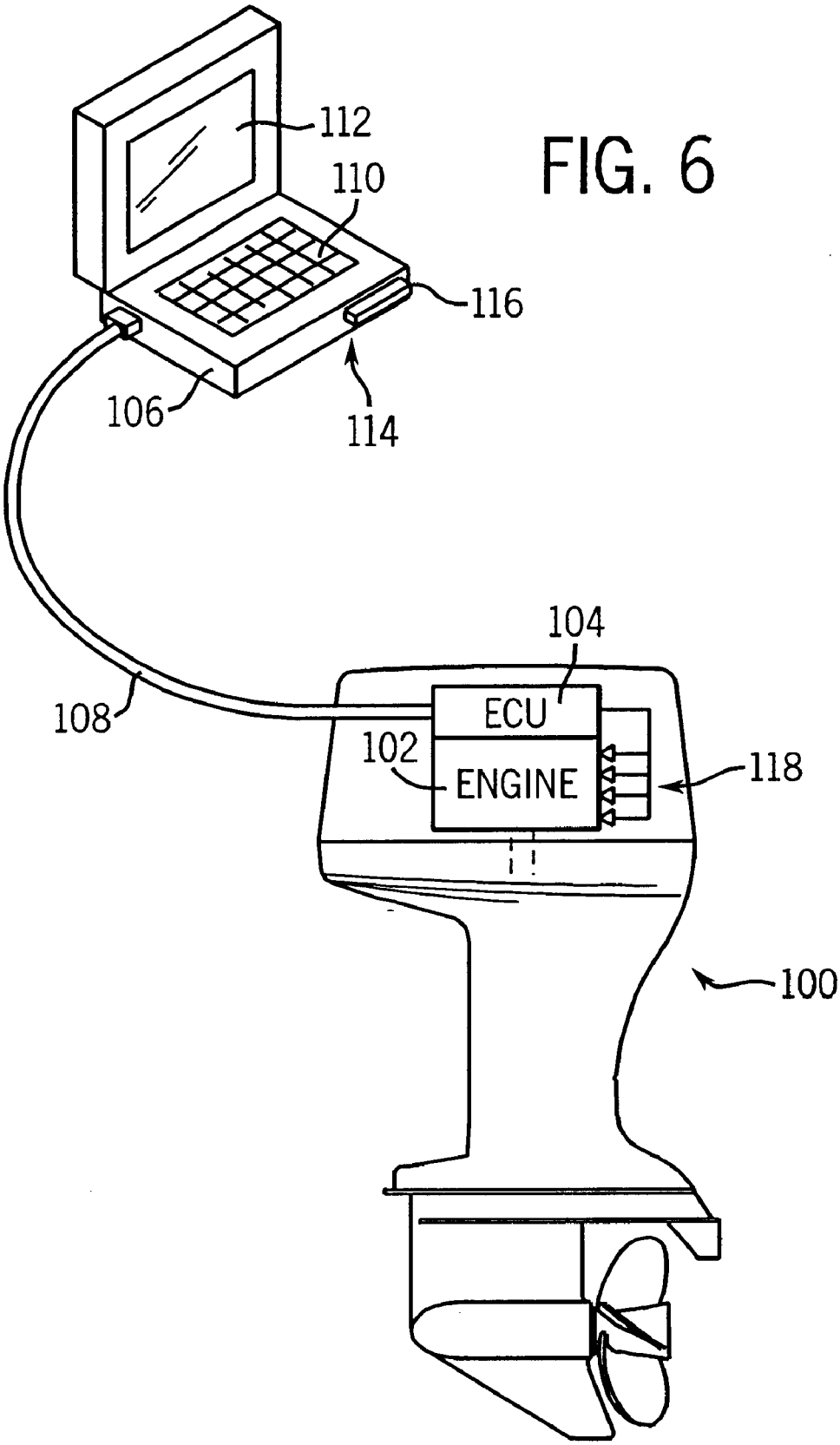
FIG. 6 is a perspective view of a fuel injected outboard marine engine having an ECU in communication with a portable processing unit, incorporating the present invention.

The operating environment of the present invention will be described with respect to a 2-cycle outboard marine engine as best shown in FIG. 6. However, it will be appreciated that this invention is equally applicable for use with a 4-cycle engine, a diesel engine, or any other type of internal combustion engine using fuel injectors.

It is well known in the art that the torque of an engine, the engine speed, engine emissions, and engine temperature can be optimized by adjusting the amount of the fuel applied to all cylinders and the time at which that fuel is ignited by using fuel injectors such as that disclosed in U.S. Pat. No. 5,687,050, incorporated herein by reference in its entirety. The amount of fuel injected into an engine cylinder is typically controlled by the width of the control pulse applied to the fuel injector to hold it open for a predetermined period of time and then closing it, thus allowing only a particular quantity of fuel to be injected into the cylinder. Thus, as can be seen in FIG. 1(*a*), curve 10 represents the pulse applied to a fuel injector to cause a certain amount of fuel to be injected into the cylinder. In a like manner, pulses 12 indicate that the ignition pulses that are supplied to the spark plug to ignite the fuel some predetermined period of time after injection of the fuel into the cylinders.

It is also well known that as the RPM of the engine increases, the fuel must be injected into the cylinders at a much earlier crankshaft position for most efficient operation of the engine. Thus, as shown in FIG. 1(*b*), pulse 10 has moved a greater distance away from the ignition pulses 12 at high engine RPM's. It was also known that by adjusting the pulse-width 10 to a width 10' or 10" as shown in FIG. 1(*b*), while monitoring the desired engine characteristics such as torque, RPM, emissions, and temperature, that the operation of the engine could be optimized. In a similar manner, it was discovered that if the ignition timing pulses 12 were varied between a range 12' or 12", while observing the desired engine operating characteristics such as torque, engine speed, emissions, and temperature, that the optimum operating conditions of the engine could be further improved.

Thus, as shown in FIG. 2, which is a block diagram of a prior art system 14 for optimizing engine operating characteristics, a first two-dimensional data storage cell array 16 was created which represents throttle position versus engine RPM setting. Cell array 16 stores a gross pulse-width data value in each cell representing the same amount of fuel to be charged into all of the engine cylinders for each given throttle position and RPM setting to optimize operation of the engine as a whole. Thus, by running the engine at 1000 RPM and adjusting the fuel injection pulse-width, the torque of the engine can be maximized, the engine speed can be maximized, the emissions can be minimized, and the operating temperature can be minimized. For a selected RPM and throttle position, an optimum fuel injection pulse-width is determined and stored that optimizes the desired engine operating characteristics. This process is then repeated for a number of throttle positions and RPM settings until an entire bit map is created to store the gross pulse-width data value in each cell to optimize operation of the engine as a whole with respect to fuel injection. The microprocessor 20 could then, at any given throttle position and RPM setting, select from the storage array the correct pulse-width to determine the fuel injection that would optimize engine operations with respect to fuel injection.

In a like manner, a second two-dimensional data storage cell array 18 is created that also represents throttle position versus engine RPM setting for storing a gross ignition timing signal in each cell representing the time at which ignition should occur in all of the cylinders for each given throttle position and RPM setting to further optimize operation of the engine as a whole with respect to ignition timing. The microprocessor 20 is connected to both of the first and second two-dimensional data storage cell arrays 16 and 18 and monitors engine RPM and throttle setting in a well-known manner. At each given RPM and throttle setting, the microprocessor 20 checks the stored data in the two-dimensional data storage cell arrays 16 and 18 and causes signals on lines 22, 24, and 26 to the various fuel injection circuits to cause the same amount of fuel to be charged into each cylinder based on the fuel injection pulse-width data stored in the bit map 16. It also caused the proper ignition of all the spark plugs 28 at the same relative time based on the data stored in the ignition timing bit map 18 for any given RPM and throttle position.

Thus, although the system illustrated in FIG. 2 improved the operation of the engines based on engine operating characteristics such as torque, engine speed, emissions, and temperature, this method simply is not satisfactory for present day requirements and is especially not satisfactory for use with engines having advanced complex fuel injectors which follow a performance curve which is defined by a third-order polynomial.

Figure 3:
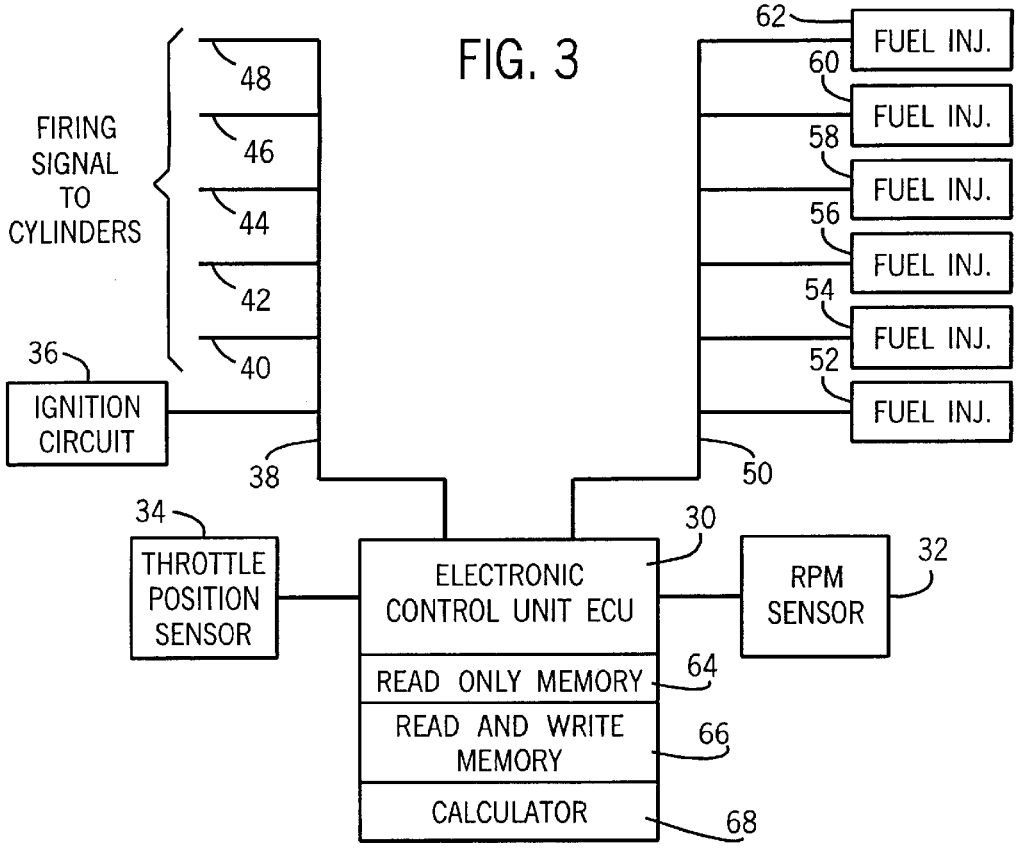
FIG. 3 is a block diagram of the present invention illustrating circuitry for determining the appropriate pulse width for providing a selected amount of fuel to achieve a desired RPM of the engine.

Referring now to FIG. 3 a block diagram is shown of an internal combustion engine assembly having a central ECU (electronic control unit) 30 which receives inputs such as engine speed from RPM sensor 32 and throttle position from sensor 34. It will also be appreciated, that one of the primary purposes of an ECU in an automobile is to control the ignition firing and timing as indicated by the ignition circuit shown as block 36 and receiving a signal from ECU 30 on line 38. As shown, the control signal from ECU 30 will also control additional cylinders such as indicated by lines 40, 42, 44, 46 and 48. It is not unusual for modern internal combustion engines of all types, whether diesel or gasoline fueled, to use fuel injectors on each cylinder to provide fuel to the cylinder for combustion. Thus, as shown, ECU 30 further provides a control signal by means of line 50 to the fuel injector solenoids indicated at 52, 54, 56, 58, 60, and 62. Thus, each cylinder of an internal combustion engine receives both an ignition firing signal and a fuel injection signal from the ECU.

In addition to those functions provided by an engine ECU in the past, the ECU used in an engine assembled for this invention will further include a memory which may typically be a read-only memory 64 for storing a third-order equation such as $ax^3+bx^2+cxd=0$ and a read/write memory 66 having storage locations associated with each cylinder of the engine for storing the coefficient data specifically associated with each fuel injector to provide fuel to that particular cylinder. The coefficient data is used in the aforementioned third-order equations stored in read-only memory 64. Thus, depending upon the throttle setting and the corresponding RPM, the equation in read-only memory 64 is provided to microprocessor or calculator 68 of ECU 30 along with the appropriate coefficient data of the third-order equation associated with the cylinder for which the volume of fuel is being determined. Microprocessor 68 then uses the equation and the corresponding coefficient data to calculate the necessary pulse width and provide the requisite amount of fuel to the appropriate fuel injection 52–62 to achieve efficient engine operation.

Figure 4:
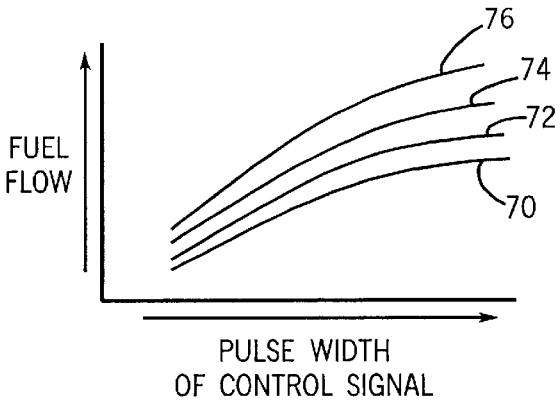
FIG. 4 shows a family of performance curves of fuel injectors which follow a second-order polynomial.

To aid in understanding the operation of the present invention and the requirement of using calculations with more advanced fuel injectors to determine pulse width, over those fuel injectors used in the past, reference is made to the set of curves illustrative of fuel injector performance of earlier less complex fuel injectors. As shown in FIG. 4, an increase in pulse width results in an increase in fuel flow in a rather predictable manner as shown by the second-order polynomial curves 70, 72, 74, and 76 representing four individual fuel injectors, as used in a four-cylinder engine. It is clear from each of these curves that if the fuel flow associated with a particular pulse width is known at several different, but known, pulse widths, because of the simple nature and the predictability, the fuel flow at any other pulse width which is not at a known point can be predicted or easily extrapolated with a fair amount of accuracy. Thus, in the prior art fuel injector control calculations it was only necessary to store a few data points which associated fuel flow with pulse width for each fuel injector and then quickly extrapolate for pulse widths for which points were not available.

Figure 5:
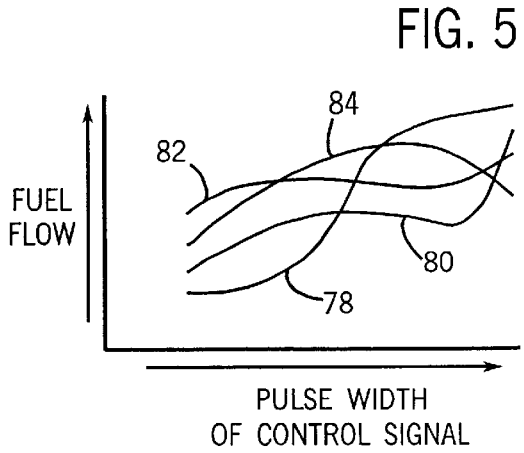
FIG. 5 shows a family of performance curves of complex fuel injectors which follow a third-order polynomial.

However, the advanced complex fuel injectors which are the subject of the present invention do not have such predictable pulse width versus fuel flow performance curves. For example, referring to FIG. 5, there is shown a set of four fuel injector performance curves 78, 80, 82, and 84 which clearly cannot be described by a second-order polynomial. Such curves require a third-order polynomial to best described the performance of these advanced complex fuel injectors. Because of the unpredictability and complexity of these performance curves, it will be appreciated that one cannot simply extrapolate between two desired fuel flow levels and determine the necessary pulse width with any degree of accuracy.

Consequently, the basic form of a third-order polynomial is stored in read-only memory 64 of ECU 30 and then for each cylinder the unique and specific coefficients which define a performance curve associated with each specific fuel injector are calculated. Then, as discussed above, by using the third-order polynomial, the necessary pulse width for a desired fuel flow can be determined.

Referring now to FIG. 6, a perspective view of an outboard marine engine 100 having a fuel injected internal combustion engine 102, controlled by an ECU 104 is shown connected to a service computer 106. In a preferred embodiment, the service computer 106 is connected to the ECU 104 with a serial cable 108. However, it is contemplated that the service computer 106 can communicate with the ECU 104 in any number of ways, including but not limited to a SCSI (Small Computer System Interface) cable and card, a USB (Universal Serial Bus) cable and port, standard parallel connection, or with wireless technology, such as by infrared transmissions. The service computer 106 may be a transportable laptop, a desktop computer, specialized service computer, or any other processing unit capable of executing and running a computer program. The service computer 106 has a keyboard 110, a monitor 112, and at least one disk drive 114. The drive 114 can receive an external disk or CD, or any other computer readable storage medium 116. The ECU 104 is individually connected to each of a number of fuel injectors 118 to control the performance of the engine, as previously described.

The invention includes a system to replace fuel injector data in an ECU 104 when replacing a fuel injector 118 in a fuel injected engine 102. The system includes a service computer 106 connectable to transmit data to the ECU 104. The service computer 106 has a computer readable storage medium 116 associated therewith and having thereon replacement fuel injector coefficient data, as previously described. A computer program is also supplied and will be described further with reference to FIG. 7. In general, the computer program includes a set of instructions which, when executed by the service computer 106, causes the service computer 106 to download an identification characteristic from the ECU 104, determine which fuel injector is to be replaced, read existing fuel injector coefficient data from the ECU for the fuel injector to be replaced, and save the existing fuel injector coefficient data. The replacement fuel injector coefficient data from the computer readable storage medium 116 is then written to the ECU 104 for the specific replacement fuel injector to be installed in engine 102.

Figure 7:
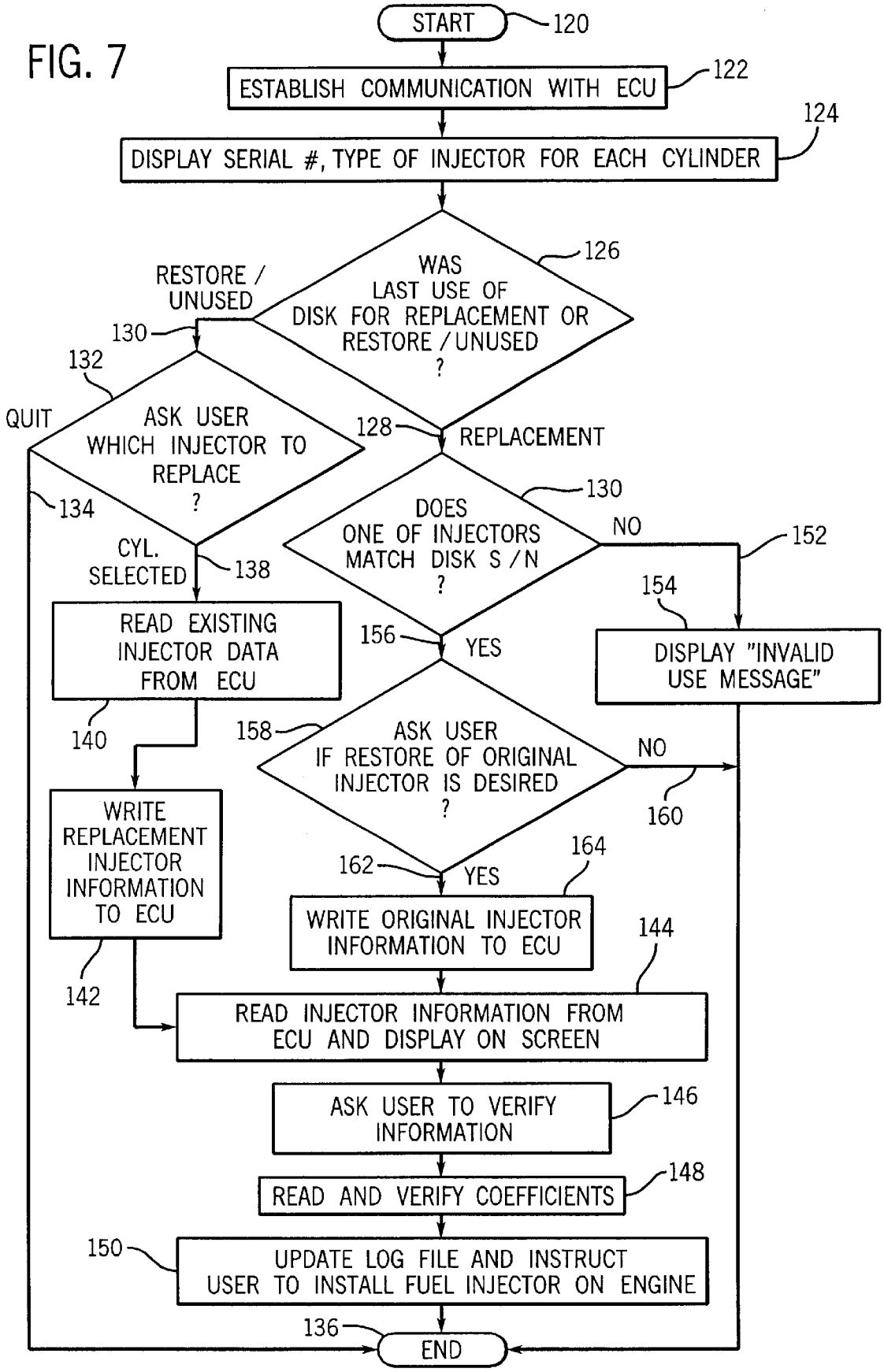
FIG. 7 is a flow chart showing an implementation of the present invention for use with the apparatus of FIG. 6.

Referring now to FIG. 7, the method steps of the present invention, together with the acts accomplished by the instructions of the computer program, are depicted in flow chart form. Upon initialization 120, communication between the ECU and the service computer is established at 122. The service computer then downloads the serial number to identify the engine and ECU, and downloads a fuel injector identification for each cylinder in the engine at 124. The service computer then displays the serial number and type of injector for each cylinder 124 and then checks 126 to see if there was a last use of the disk, and whether the last use of the disk was for replacement 128 of the coefficient data or whether there had already been a restoration or if this is the first use of the disk 130.

The first time the computer program and the coefficient data are used 126, 130, the user is first asked which injector is sought to be replaced 132. If for some reason, the user does not wish to proceed, the user can exit the program 134, 136 by pressing the Esc key on the service computer 106, in a preferred embodiment. This branch may also be followed if a time out feature is added in case the user does not respond to the inquiry at 132. Further, this exit path is also desirable in the event a user wants to just confirm that the service computer is properly communicating with a given ECU even if replacement of an injector in that particular engine is not desired.

Once the user selects an injector to be replaced 132, 138, the service computer reads the existing fuel injector coefficient data from the ECU at 140 and saves it to the computer readable storage medium. The replacement fuel injector coefficient data is then read from the storage medium and written to the ECU 142, and then read back from the ECU at 144 to verify accuracy of the written replacement fuel injector coefficient data. The cylinder for which data was written, together with the fuel injector serial number can also be displayed on the service computer at 144 and the user is then asked to verify the accuracy of the information displayed 146. The service computer then checks the read back coefficient data with the replacement fuel coefficient data from the computer readable storage medium and verifies that the coefficients were written accurately 148. The service computer then updates a log file 150 to record the previous path and instruction set which was just previously executed. In the aforementioned example, the log file records that the last action taken was the first use, or the restore/unused function. Once the log file is updated, the user is instructed to physically install the replacement fuel injector in the particular cylinder previously selected 150, after which the program exists at 136.

Once the program has been initially used, and it is desired to restore the original coefficient data because, for example, the new injector did not solve whatever service problem was being experienced. In such a case, the service personnel may wish to reinstall the old injector. Upon initialization 120 and after the service computer establishes communication with the ECU 122, the system acquires and displays the serial number and type of injectors for each cylinder 124. The program then determines that since the last use was a restore/unused function 130, the only permissible path to be taken is the restoration path 128. That is, the last use of the disk was for replacement of the original coefficient data. The program now restricts the use of the original fuel injector coefficients by checking to see if one of the injectors in the engine matches the serial number on the computer readable storage medium 130. If it does not 152, an invalid use message is displayed 154 and the program exists at 136 indicating that the fuel injector that came with this disk and the replacement coefficient data is not installed in this particular engine. However, if one of the serial numbers of the injectors in the engine matches the serial number on the disk 130, 156, the user is asked if the original fuel injector coefficient data is to be restored in the ECU at 158. If the user does not wish to restore the original coefficient data 160 the program then ends at 136.

However, assuming that the user wishes to restore the original fuel injector coefficient data 158, 162, the original coefficient data is written to the ECU at 164 and then read back at 144. The injector serial number and cylinder number are then displayed on the service computer. The user is then asked to verify the information displayed at 146 and the service computer verifies the accuracy of the coefficient data that is written in the ECU with that on the computer readable storage medium at 148. The log file is then updated at 150 to indicate that the original fuel injector coefficient data has been reinstalled in the engine which indicates that the new, replacement fuel injector coefficient data, together with the new fuel injector may be reused in another engine. The user is then instructed to install the original injector back into the cylinder at issue in the engine at 150 and the program is then complete at 136.

It should now be apparent that the computer program, together with the data file and the new injector may be used in another cylinder or another engine.

The present invention contemplates the use of a fuel injector of a type commonly referred to as single fluid pressure surge direct delivery fuel injector used in gasoline engines, and more specifically, in 2-stroke gasoline engines. One application of such an injector is a 2-stroke gasoline outboard marine engine, as shown in FIG. 6. These fuel injectors typically do not entrain the gasoline in a gaseous mixture before injection. However, it will be appreciated by those skilled in the art that the above-described invention is equally suited for use with other types of injectors. Another type of direct fuel delivery uses a high pressure pump for pressurizing a high pressure line to deliver fuel to the fuel injector through a fuel rail that delivers fuel to each injector. A pressure control valve may be coupled at one end of the fuel rail to regulate the level of pressure of the fuel supplied to the injectors to maintain a substantially constant pressure. The pressure may be maintained by dumping excess fuel back to the vapor separator through a suitable return line. The fuel rail may incorporate nipples that allow the fuel injectors to receive fuel from the fuel rail. Thus, in this case, a substantially steady pressure differential, as opposed to a pressure surge, between the fuel rail and the nipples cause the fuel to be injected into the fuel chamber. Another example of direct fuel injection is a direct dual-fluid injection system that includes a compressor or other compressing means configured to provide a source of gas under pressure to effect injection of the fuel to the engine. That is, fuel injectors that deliver a metered individual quantity of fuel entrained in a gaseous mixture. It is to be understood, however, that the present invention is not limited to any particular type of direct fuel injector.

Accordingly, the invention includes a method of servicing an engine requiring fuel injector replacement that includes identifying a fuel injector in need of replacement by cylinder number and establishing communication between a service computer and an ECU of the engine. The method next includes downloading identification of the ECU, the engine, and the fuel injector from the ECU to the service computer, writing replacement fuel injector coefficient data into the ECU for a given replacement fuel injector for the cylinder number identified, and installing the replacement fuel injector in the cylinder number identified.

Preferably, the method includes downloading and storing the existing fuel injector coefficient data prior to writing over the memory locations containing the coefficient data, and then restricting use to restoration in the engine from which it was originally downloaded. In this preferred embodiment, the method includes displaying an injector serial number, an injector-type for each cylinder, determining if the replacement fuel injector coefficient data has been uploaded previously, and if so, determining whether an injector serial number in the engine matches a serial number of the replacement fuel injector. If there is a match, the restoration is allowed to proceed by uploading the existing fuel injector coefficient data back into the ECU. In order to verify the data loaded in the ECU, the method also includes reading the written replacement fuel injector coefficient data back from the ECU, displaying the cylinder number in which the replacement fuel injector is to be installed so that a user can verify the cylinder number. The written replacement fuel injector coefficient data is then verified by comparing the data with the replacement fuel injector coefficient data on the computer readable storage medium. The method includes supplying a production fuel injector having a performance curve defined by a third-order polynomial and wherein the production fuel injector is flow rate tested to determine a set of custom coefficients for the third-order polynomial. The method includes supplying a computer readable or readable/writable storage medium, such as a CD or a computer disk, with the production fuel injector wherein the computer readable storage medium has stored thereon a single set of custom coefficients that correspond to the particular production fuel injector and a computer program that is capable of causing the service computer to execute instructions which effectuates the aforementioned steps of downloading, writing, and installing.

The invention also includes a fuel injector service pack which includes a single replacement fuel injector and a computer readable storage medium. The fuel injector has a fuel flow rate that is characterized by a custom set of coefficients that are experimentally determined for that particular fuel injector and fit a third-order polynomial that defines a performance curve of the fuel injector. The computer readable storage medium has at least a data file and a computer program stored thereon. The computer file contains a serial number of the replacement fuel injector and the custom set of coefficients for the replacement fuel injector. The computer program stored on the computer readable storage medium includes instructions which when executed by the computer, cause the computer to (1) allow identification of a cylinder in a fuel injected engine for which a fuel injector is to be replaced, (2) read and store existing fuel injector coefficient data from an ECU of the fuel injected engine, and (3) write the custom set of coefficients from the data file to the ECU for use with the single replacement fuel injector.

The computer readable storage medium also preferably includes a log file for which the computer program maintains a history of actions taken by the computer program to ensure, as good as possible, that the matched set of custom coefficients and the single replacement fuel injector are kept together. The computer program of the service pack also causes the computer to allow restoration of the existing fuel injector coefficient data if the single replacement fuel injector did not solve a user's service problem. It also restricts use of the existing fuel injector coefficient data and the original fuel injector by first writing a serial number of the single replacement fuel injector to the ECU when the custom set of coefficients are written to the ECU, and then later, if the last use of the computer program was to replace data, then reading and comparing each fuel injector serial number in the ECU with the serial number of the single replacement fuel injector as stored in the data file when the computer program receives another execution command. If a match exists, the software allows the existing fuel injector coefficient data to be written back into the ECU and directs that the original fuel injector be reinstalled in the cylinder identified to match with the existing fuel injector coefficient data.

The invention also includes a method of providing replacement fuel injectors for an engine including supplying a production fuel injector with relaxed tolerances as compared to a standard service injector, acquiring a set of coefficients that characterize a performance curve for that particular production fuel injector, and writing the set of coefficients to a transportable computer readable medium. The method also includes providing a computer program on a transportable computer readable medium that, when executed, causes a computer to load the set of coefficients into an ECU of an engine in which the production fuel injector is to be installed.

In accordance with this aspect of the invention, each of the production fuel injectors is fuel flow tested in order to determine a set of coefficients to be supplied with that particular production fuel injector. Preferably, the method also includes the steps of reading and storing existing fuel injector coefficient data from the ECU before writing over the data, and allowing restoration of that existing fuel injector coefficient data if the replacement procedure did not result in a satisfactory outcome. The program restricts use of the existing fuel injector coefficient data and the original fuel injector by writing a serial number of the production fuel injector to the ECU, and upon a request to restore data, reading and comparing each fuel injector serial number in the ECU with the serial number of the production fuel injector. If a match exists, the existing fuel injector coefficient data is allowed to be written back into the ECU, if not, the execution is halted. The method includes directing that the original fuel injector be installed in the appropriate cylinder if that action was deemed allowable, as previously identified.

The present invention has been described in terms of the preferred embodiment, and it is recognized that equivalents, alternatives, and modifications, aside from those expressly stated, are possible and within the scope of the appending claims.

What is claimed is:

1. A system to input fuel injector data in an ECU when replacing a fuel injector in an engine comprising:

a computer readable storage medium operable with a service computer connectable to transmit data to an ECU of an engine, the computer readable storage medium having thereon replacement fuel injector coefficient data and a computer program which, when executed by the service computer, causes the service computer to write the replacement fuel injector coefficient data to the ECU for use with a specified replacement fuel injector.

2. The system of claim 1 wherein the computer program further causes the service computer to:

download an identification characteristic from the ECU;

determine which fuel injector is to be replaced;

read existing fuel injector coefficient data from the ECU for the fuel injector to be replaced; and save the existing fuel injector coefficient data for use by the computer program in an event that the specified replacement fuel injector is reinstalled in the engine.

3. The system of claim 2 wherein the computer program further causes the service computer to acquire a fuel injector identification for each cylinder in the engine.

4. The system of claim 2 wherein the computer program further causes the service computer to allow restoration of the existing injector coefficient data and restricts such restoration to the engine in which the ECU has the replacement fuel injector coefficient data written.

5. The system of claim 2 wherein the computer program further causes the service computer to maintain a log of how the computer program is used to thereby restrict use of the existing fuel injector coefficient data and the replacement fuel injector coefficient data.

6. The system of claim 2 wherein the computer program further causes the service computer to read the written replacement fuel injector coefficient data from the ECU and to verify accuracy of the written replacement fuel injector coefficient data with the replacement fuel injector data on the computer readable storage medium.

7. The system of claim 1 further comprising a production fuel injector having a performance curve defined by a third-order polynomial and wherein the production fuel injector is flow rate tested to determine a set of custom coefficients for the third-order polynomial.

8. The system of claim 7 further comprising an ECU that has a set of standard service coefficients therein, and is preprogrammed to use the set of standard service coefficients when a service fuel injector is installed and wherein the service fuel injector is manufactured with such tolerances so as to use the set of standard service coefficients.

9. The system of claim 8 wherein the production fuel injector is manufactured with wider tolerances than the service fuel injector, but wherein the operation of the production fuel injector using the set of custom coefficients provides more precise fuel flow than the service fuel injector using the standard service coefficients.

10. A method of servicing an engine requiring fuel injector replacement comprising the steps of:

identifying a fuel injector in need of replacement by cylinder number;

establishing communication between a service computer and an ECU of the engine;

downloading ECU, engine, and fuel injector data from the ECU to the service computer;

writing replacement fuel injector coefficient data in the ECU for a replacement fuel injector for the cylinder number identified; and installing the replacement fuel injector in the cylinder number identified.

11. The method of claim 10 wherein the step of downloading further includes downloading existing fuel injector coefficient data and the method further includes the steps of storing the existing fuel injector coefficient data, and restricting a user to restoring the existing fuel injector coefficient data in the engine from which it was downloaded.

12. The method of claim 11 further comprising the steps of:

displaying an injector serial number and injector type for each cylinder;

determining if the replacement fuel injector coefficient data has been uploaded previously, and if so, determining whether any injector serial number in the engine matches a serial number of the replacement fuel injector, and if so, allowing restoration of the existing fuel injector coefficient data.

13. The method of claim 10 further comprising the steps of:

reading the written replacement fuel injector coefficient data back from the ECU;

displaying the cylinder number in which the replacement fuel injector is to be installed; and verifying the written replacement fuel injector coefficient data with the replacement fuel injector coefficient data.

14. The method of claim 10 further comprising the steps of:

supplying a production fuel injector having a performance curve defined by a third-order polynomial and wherein the production fuel injector is flow rate tested to determine a set of custom coefficients for the third-order polynomial;

supplying a computer readable storage medium with the production fuel injector wherein the computer readable storage medium has stored thereon a single set of custom coefficients that correspond to that particular production fuel injector and a computer program that is capable of causing the service computer to execute the steps of downloading, writing and installing as called for in claim 10.

15. A fuel injector service pack comprising:

(A) a single replacement fuel injector having a fuel flow characterized by a custom set of coefficients that are experimentally determined for that particular fuel injector; and (B) a computer readable storage medium having stored thereon:

(i) a data file containing a serial number and the custom set of coefficients for the single replacement fuel injector; and (ii) a computer program comprising instructions which, when executed by a computer, cause the computer to:

(1) allow identification of a cylinder in a fuel injected engine for which a fuel injector is to be replaced;

(2) read and store existing fuel injector coefficient data from an ECU of the fuel injected engine;

(3) write the custom set of coefficients from the data file to the ECU for use with the single replacement fuel injector.

16. The fuel injector service pack of claim 15 wherein the computer readable storage medium further comprises a log file that is used by the computer program to track how the data file is used and ensure that the custom set of coefficients are not used with another fuel injector.

17. The fuel injector service pack of claim 15 wherein the single replacement fuel injector has a fuel flow defined by a third-order polynomial.

18. The fuel injector service pack of claim 15 wherein the computer program further causes the computer to:

allow restoration of the existing fuel injector coefficient data if the single replacement fuel injector did not solve a user problem and restricts use of the existing fuel injector coefficient data and the original fuel injector by: writing a serial number of the single replacement fuel injector to the ECU when the custom set of coefficients are written to the ECU;

if the last use of the computer program was to replace data, reading and comparing each fuel injector serial number in the ECU with the serial number of the single replacement fuel injector as stored in the data file and if a match is present, allowing the existing fuel injector coefficient data to be written back into the ECU; and directing that the original fuel injector be installed in the cylinder identified.

19. A method of providing replacement fuel injectors for an engine comprising the steps of:

supplying a production fuel injector with relaxed tolerances as compared to a standard service fuel injector;

acquiring a set of coefficients that characterize a performance curve for that particular production fuel injector;

writing the set of coefficients to a transportable computer readable medium; and providing a computer program on a transportable computer readable medium that, when executed, causes a transportable service computer to load the set of coefficients into an ECU of an engine in which the production fuel injector is to be installed.

20. The method of claim 19 further comprising the step of running a fuel flow test on the particular production fuel injector to acquire the set of coefficients.

21. The method of claim 19 further comprising the steps of:

reading and storing existing fuel injector coefficient data from the ECU; and allowing restoration of the existing fuel injector coefficient data and restricting use of the existing fuel injector coefficient data and the original fuel injector by:

writing a serial number of the production fuel injector to the ECU;

upon a request to restore data, reading and comparing each fuel injector serial number in the ECU with the serial number of the production fuel injector, and if a match is present, allowing the existing fuel injector coefficient data to be written back into the ECU; and directing that the original fuel injector be installed in the cylinder identified.

22. The method of claim 19 wherein the production fuel injector has a fuel flow defined by a third-order polynomial.

23. A system to replace fuel injector data in an ECU when replacing a fuel injector in an engine comprising:

a computer readable storage medium operable with a service computer connectable to transmit data to an ECU of an engine, the computer readable storage medium having thereon replacement fuel injector coefficient data and a computer program which, when executed by the service computer, causes the service computer to write the replacement fuel injector coefficient data to the ECU for a specified replacement fuel injector, wherein the specified replacement fuel injector has a performance curve defined by a third-order polynomial and is flow rate tested to determine the replacement fuel injector coefficient data for the third-order polynomial.

24. The system of claim 23 further comprising a replacement fuel injector suitable for use on a 2-cycle engine.

25. The system of claim 24 wherein the 2-cycle engine is an outboard marine engine.

26. A system to input fuel injector data in an ECU of an engine when replacing a fuel injector in the engine comprising:

an engine having an ECU that controls a plurality of fuel injectors, wherein each fuel injector is of a type that directly injects gasoline into a cylinder of an internal combustion engine; and a computer readable storage medium operable with a service computer connectable to transmit data to the ECU of the engine, the computer readable storage medium having thereon replacement fuel injector coefficient data and a computer program which, when executed by the service computer, causes the service computer to write the replacement fuel injector coefficient data to the ECU for use with a specified replacement fuel injector in a specified cylinder of the engine.

27. The system of claim 26 wherein the computer program further causes the service computer to:

download an identification characteristic from the ECU;

determine which fuel injector is to be replaced;

read existing fuel injector coefficient data from the ECU for the specified replacement fuel injector to be replaced; and save the existing fuel injector coefficient data for reuse in the ECU if the replacement fuel injector does not solve a service problem.

28. The system of claim 26 wherein the fuel injector is configured to deliver gasoline that is entrained in a gas.

29. The system of claim 26 wherein the fuel injector is configured to deliver gasoline that is not entrained in a gas.

30. The system of claim 29 wherein the fuel injector is configured to deliver gasoline by a pressure surge.

31. The system of claim 29 wherein the fuel injector is configured to deliver gasoline by a pressure differential.

32. A system to input fuel injector data in an ECU when replacing a fuel injector in an engine comprising:

means for identifying a fuel injector in need of replacement by cylinder number of an engine;

means for establishing communication between a service computer and an ECU of the engine;

means for downloading an identification characteristic from the ECU; and means for writing fuel injector coefficient data in the ECU for a replacement fuel injector for the cylinder number identified.

* * * * *